US012121111B1

(12) United States Patent
Sepeda et al.

(10) Patent No.: US 12,121,111 B1
(45) Date of Patent: Oct. 22, 2024

(54) FOOTWEAR STRETCHER APPARATUS

(71) Applicant: ZAP-RAMS CORPORATION, North Las Vegas, NV (US)

(72) Inventors: Alberto Sepeda, North Las Vegas, NV (US); Daniel Sepeda, North Las Vegas, NV (US)

(73) Assignee: ZAP-RAMS CORPORATION

( * ) Notice: Subject to any disclaimer, the term of this patent is extended or adjusted under 35 U.S.C. 154(b) by 0 days.

(21) Appl. No.: 18/747,374

(22) Filed: Jun. 18, 2024

(51) Int. Cl.
*A43D 3/14* (2006.01)
*A43D 3/08* (2006.01)

(52) U.S. Cl.
CPC ..... *A43D 3/14* (2013.01); *A43D 3/08* (2013.01); *A43D 3/145* (2013.01); *A43D 3/1458* (2013.01)

(58) Field of Classification Search
CPC ..... A43D 3/08; A43D 3/14; A43D 3/1441; A43D 3/145; A43D 3/1458
USPC ..... 12/114.2, 114.6, 116.8, 117.2, 119.5, 12/115.2
See application file for complete search history.

(56) References Cited

U.S. PATENT DOCUMENTS 17,067 A * 4/1857 Willmott ..... A43D 3/1416 12/114.6
441,657 A * 12/1890 Gillard et al. ..... A43D 95/02 12/114.6
565,341 A * 8/1896 Fletcher ..... A43D 3/08 12/117.2
658,790 A * 10/1900 Leighton ..... A43D 3/08 12/117.2
728,533 A * 5/1903 Baker ..... A47L 23/18 12/114.2
2,069,537 A * 2/1937 Panos ..... A43D 3/08 12/116.2
2,104,839 A * 1/1938 Panos ..... A43D 3/08 12/116.2
2,549,502 A * 4/1951 McClenathan ..... A43D 3/08 12/117.2
3,276,053 A * 10/1966 McKesson ..... A43D 3/1416 223/63

FOREIGN PATENT DOCUMENTS

GB 1283478 A * 7/1972

OTHER PUBLICATIONS

U.S. Pat. No. 328,642 John K. Brown published on Oct. 20, 1885.
Internet https://www.findyourboots.com/boots/how-to-stretch-leather-boots-around-the-calf (pdf provided), Year: 2020.

* cited by examiner

*Primary Examiner* — Ted Kavanaugh

(57) ABSTRACT

The invention pertains to a footwear stretcher apparatus comprising:
- two spacer blocs separated by a wedge-shaped gap and configured to be inserted inside walls of a footwear;
- an actuator; and
- a wedge, driven by the actuator, and configured to change a spacing of the wedge-shaped gap proportional to a stroke of the actuator, thus stretching the walls of the footwear.

10 Claims, 6 Drawing Sheets

FOOTWEAR STRETCHER APPARATUS

BACKGROUND OF THE INVENTION

The invention belongs the field of shoemaking and footwear retail.

More specifically the invention pertains to an apparatus for quickly adjusting a shoe or a boot in wideness at insole, instep, ankle and shaft circumferences, all taken alone or in combination, directly at a shoe retail shop.

Consumer grade shoes and boots are manufactured according to size charts fitting an average consumer foot and calf measurements.

Although some brands are proposing a set of different wideness as well as half or even quarter sizes, leading to an important inventory to maintain by the retail shop, some consumers may exhibit specific measurements and also variations in size between the right foot and the left foot, that do not allow to find the right measurements combinations in the shop inventory.

For over 150 years there have been apparatuses derived from shoe trees enabling to stretch some parts of a shoe, more particularly the vamp width and the instep.

Those devices from the prior art are generally designed as a wooden foot profile comprising split parts separated by gaps, with a screw or a spring-loaded mechanism enabling, once the device is inserted into a shoe, to exert an internal stretching pressure on the walls of the shoe, by increasing the gaps between the split parts.

Using such devices enables to stretch and to widen a footwear and to make it fitter to the foot of a customer. However, the action of such a device takes hours and even days. Therefore, those devices are not really adapted to a retail shop where the customer expects to leave the shop with a pair of shoes or boots that fits its own feet and calves measurements.

SUMMARY OF THE INVENTION

The apparatus disclosed herein aims at solving the above-mentioned deficiencies and to this end pertains to a footwear stretcher apparatus comprising:

- two spacer blocs separated by a wedge-shaped gap and configured to be inserted inside walls of a footwear;
- a power actuator; and
- a wedge, driven by the power actuator, and configured to change a spacing of the wedge-shaped gap during a stroke of the power actuator, thus stretching the walls of the footwear.

Using a power actuator enables to apply a stretching pressure high enough to durably stretch a portion of the footwear in a matter of seconds.

The above apparatus may be implemented according to the embodiments and variants described hereafter that should be considered individually or according to any operating combination.

According to variants, the power actuator may be selected among a hydraulic cylinder, a screw jack driven by an electric motor and a rack and pinion mechanism driven by an electric motor.

In a specific embodiment, the apparatus may comprise a stretching sensor and a drive controller of the power actuator configured to limit the stroke according to a preset stretching force.

In a first embodiment, the footwear is a boot, and the spacer blocs are shaft spacer blocs comprising a conical shape of a semi-circular section configured to be inserted inside a shaft of the boot and wherein the wedge is a circular puck, attached to an end of a rod driven by the power actuator and configured to translate in the gap between the two shaft spacer blocs.

Advantageously, one of the shaft spacer blocs may comprise a bulge at a distal end.

In a preferred implementation of the first embodiment, a proximal end of a shaft spacer bloc is connected to a frame by a connecting rod comprising a first pivotal link with the frame and a second pivotal link with the shaft spacer bloc.

Advantageously, the first pivotal link is spring loaded and comprises a setting mechanism configured to adjust a conicity of the wedge-shaped gap.

In a second embodiment, the apparatus comprises two bootie spacer blocs each comprising a shoe tree shape, releasably attached to a stud extending parallel to a lengthwise direction of the footwear, the stud being attached to a rod pivotably mounted to a frame with a rotation axis perpendicular to the stud, wherein the wedge and the power actuator are configured to pivotably space the bootie spacer blocs by pivoting the studs outwardly during a stroke of the power actuator.

According to a third embodiment, the apparatus comprises:

- a frame;
- a first stretching set attached to the frame wherein a first stretching set comprises two shaft spacer blocs comprising a conical shape of a semi-circular section configured to be inserted inside a shaft of a boot and wherein the wedge is a circular puck, attached to an end of a rod of a first power actuator and configured to translate in the gap between the two shaft spacer blocs;
- a second set attached to the frame wherein two bootie spacer blocs each comprising a shoe tree shape, releasably attached to a stud extending parallel to a lengthwise direction of the footwear the stud being attached to a rod pivotably mounted to a frame with a rotation axis perpendicular to the stud, wherein a wedge and a second power actuator are configured to pivotably space the bootie spacer blocs by pivoting the studs outwardly during a stroke of the second power actuator; and
- a power drive configured to drive the first and the second power actuators.

BRIEF DESCRIPTION OF DRAWINGS

The apparatus may be implemented according to the preferred non-limiting embodiments, described hereafter in reference to FIGS. 1 to 6 in which.

DETAILED DESCRIPTION OF THE INVENTION

Figure 1:
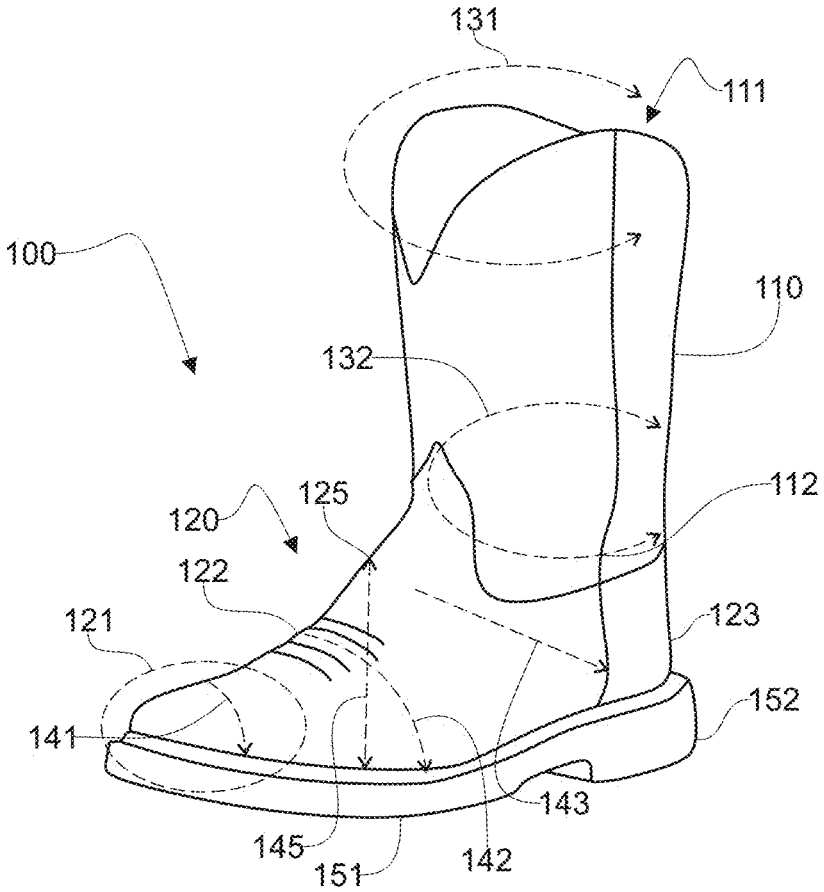
FIG. 1 is a perspective view of a western style boot showing exemplary parameters that may be adjusted with the apparatus.

FIG. 1 shows an exemplary western style boot. It comprises a shaft (110) extending between a collar (111) and a throat (112), leading to a bootie connected, by stitching and/or by gluing to a sole (151) and a heel (152).

The bootie comprises a toe box (121), a vamp (122), and a counter (123). Adjusting a boot to a customer anatomy may require stretching, alone or in combination, a collar circumference (131), a throat circumference (132), a toe box width (141), a vamp width (142), an ankle width (143) of the counter (123), a height/thickness (145) at the instep (125).

Therefore, a footwear stretching apparatus may enable to apply a stretching pressure at least on these different locations alone or in combination.

To this end the stretching apparatus may comprise two stretching sets, a first stretching set, adapted to adjust the parameters connected to the shaft shape, including the collar circumference (131), throat circumference (132), the ankle width (143) and the instep height/thickness (142); and a second stretching set adapted to adjust the parameters of the bootie including the toe box width (141), the vamp wideness (142) and the instep height/thickness (142). The instep being at a junction between the shaft and the bootie.

Although the above parameters are described for a western style boot, the person skilled in the art understands that those parameters, at least part of them, are relevant to any footwear, like a laced boot, army boot, tennis, sneaker, loafer, oxford, brogues and others.

Figure 2:
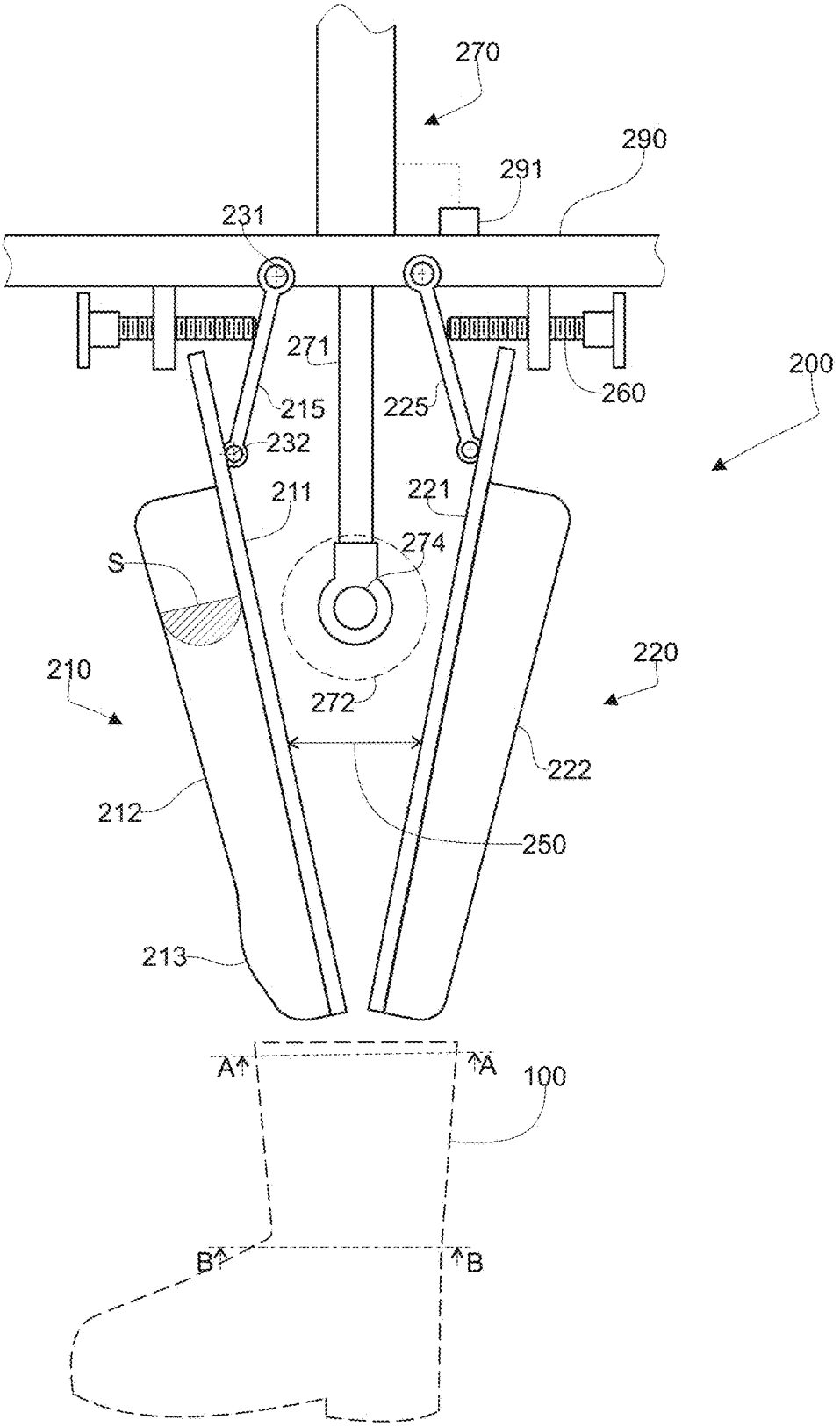
FIG. 2 is a front view of a first embodiment of the apparatus in a configuration prior to a stretching operation.

FIG. 2 according to an exemplary embodiment of a first stretching set (200) adapted to adjusting the parameters of the shaft of a footwear, the first set comprises two shaft spacer blocs (210 220), each shaft spacer bloc is connected to a frame (290) at a proximal end by a connecting rod (215, 225) comprising a first pivotal link (231) with the frame and a second pivotal link (232) with one of the shaft spacer blocs (210, 220).

According to an embodiment, a shaft spacer bloc (210, 220) comprises a rail (211, 221) connected to the connecting rod (215, 225) by the second pivotal link (231) on which a shape (212, 222) is assembled.

Each shape is conical with a semi-circular section(S) shrinking from the proximal end to a distal end.

For example, the rails (211, 221) are made of steel and the shapes (212, 222) may be made of an aluminum alloy, a plastic material or wood.

One of the shapes, here the first shape (212), may comprise a bulge (213) at its distal end. Such a bulge (213) is configured to stretch the instep or the counter area of a boot as explained later.

The two shaft spacer blocs (210, 220) are separated on an inner side, measured between the rails (211, 221), by a wedge-shaped gap (250) shrinking form the proximal ends to the distal ends of the spacer blocs.

FIG. 2 shows the first stretching set in a free configuration.

According to an embodiment the two shaft spacer blocs are hung vertically by the connecting rods (215, 225), and being of conical shape, the two shaft spacer blocs (210 220) are hanging canted which enables to apply a soft pressure inside the walls of the shaft and maintaining the boot put on the pair of the of shaft spacer blocs in a relative position to these shaft spacer blocs before the stretching operation is performed.

A screw (260) acting on the connecting rod (215, 225) allows to set an external conicity profile of the shaft space blocs in order to adapt it to the boot shaft dimension, In another embodiment the first pivotal link (231) is spring loaded so that each connecting rod (215, 225) tends to pivot outwardly toward the frame by the action of a spring, for example a torsional spring. In such a configuration a distance between the shaft spacer blocs and a conicity of the wedge-shaped gap (250) along the shaft spacer blocs are set by a setting mechanism comprising, a screw (260) acting on the connecting rod (215, 225).

According to this embodiment tightening the screw (260) pushes the connecting rod (215, 225) against the spring action. The pivoting of the connecting rod around the first pivotal link (231) by the pushing of the screw tends to reduce the distance between the shaft spacer blocs at the proximal end and to increase the gap at the distal end of the shaft spacer blocs (210, 220).

The latter embodiment makes it possible to install the first stretching set (200) either horizontally or vertically.

A first power actuator (270) comprises a rod (271) extending inbetween the shaft spacer blocs and holding a circular puck (272) configured to act as a wedge between the two spacer blocs.

As non-limiting examples, the first power actuator may be a hydraulic cylinder, or a screw jack or a rack and pinion mechanism driven by an electric motor.

Figure 3:
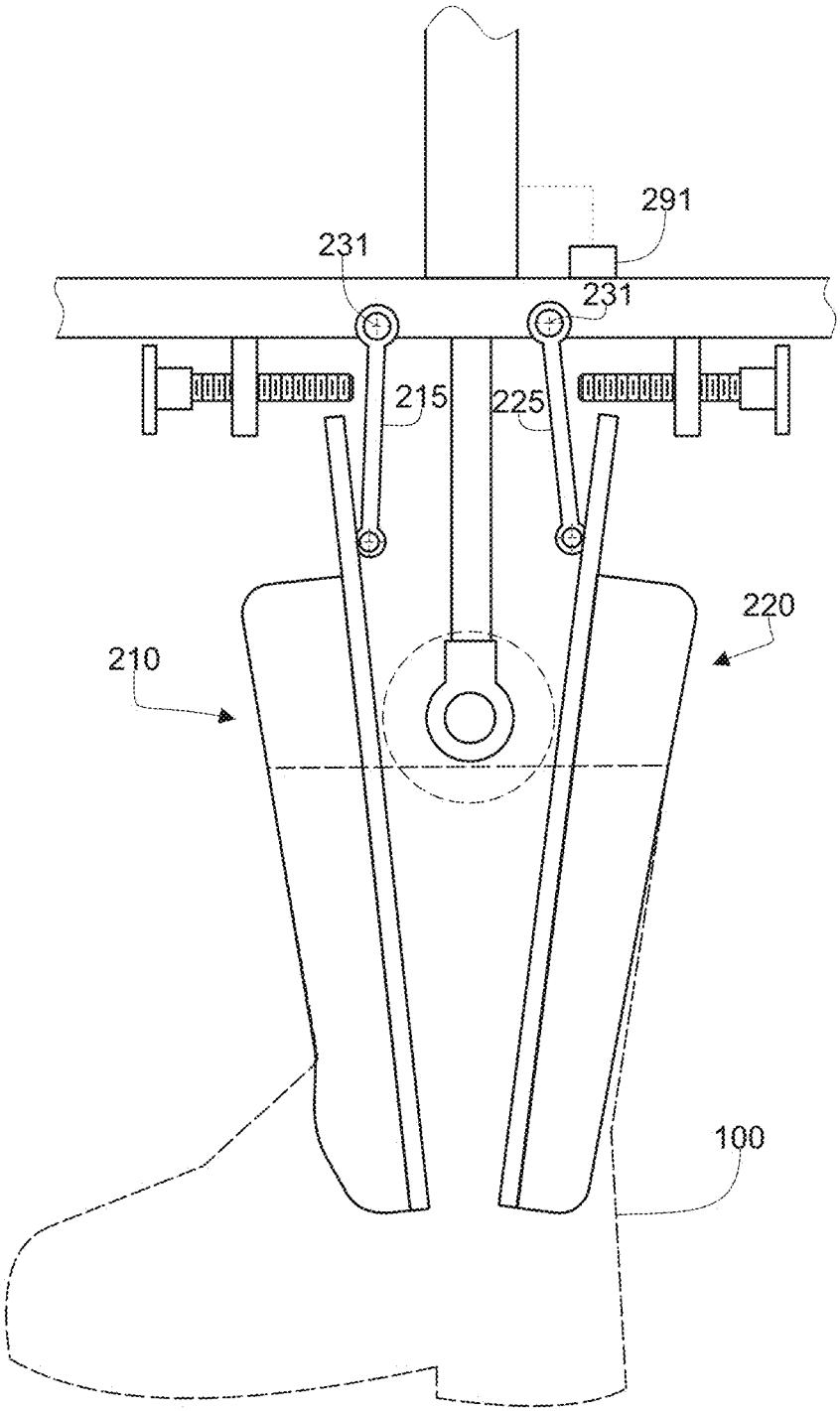
FIG. 3 is a front view of the apparatus of FIG. 2 in a configuration where a boot is set on the apparatus before stretching.

FIG. 3 starting from the configurations of FIG. 2 the two shaft spacer blocs may be inserted inside the walls of the shaft of a boot (100).

In the configuration of FIG. 2 the boot (100) is simply set on the first stretching set and the shaft of the boot is submitted to a limited stretching action, enough to maintain the boot on the spacer blocs, either by the effect of gravity acting on the shaft spacer blocs or by the effect of the spring-loaded first pivotal links (231) of the connecting rods (215, 235).

Whatever the embodiment, because of this initial holding pressure applied by the shaft spacer blocs (210, 220) on the internal walls of the shaft, the boot may be set at any height/position on the shaft spacer blocs, with the collar either closer to the distal ends of the shaft spacer blocs, for a further stretching mainly applied to the collar or with the collar closer to the distal ends of the spacer blocs, for a maximum stretching pressure further applied to the instep or the counter.

Figure 4:
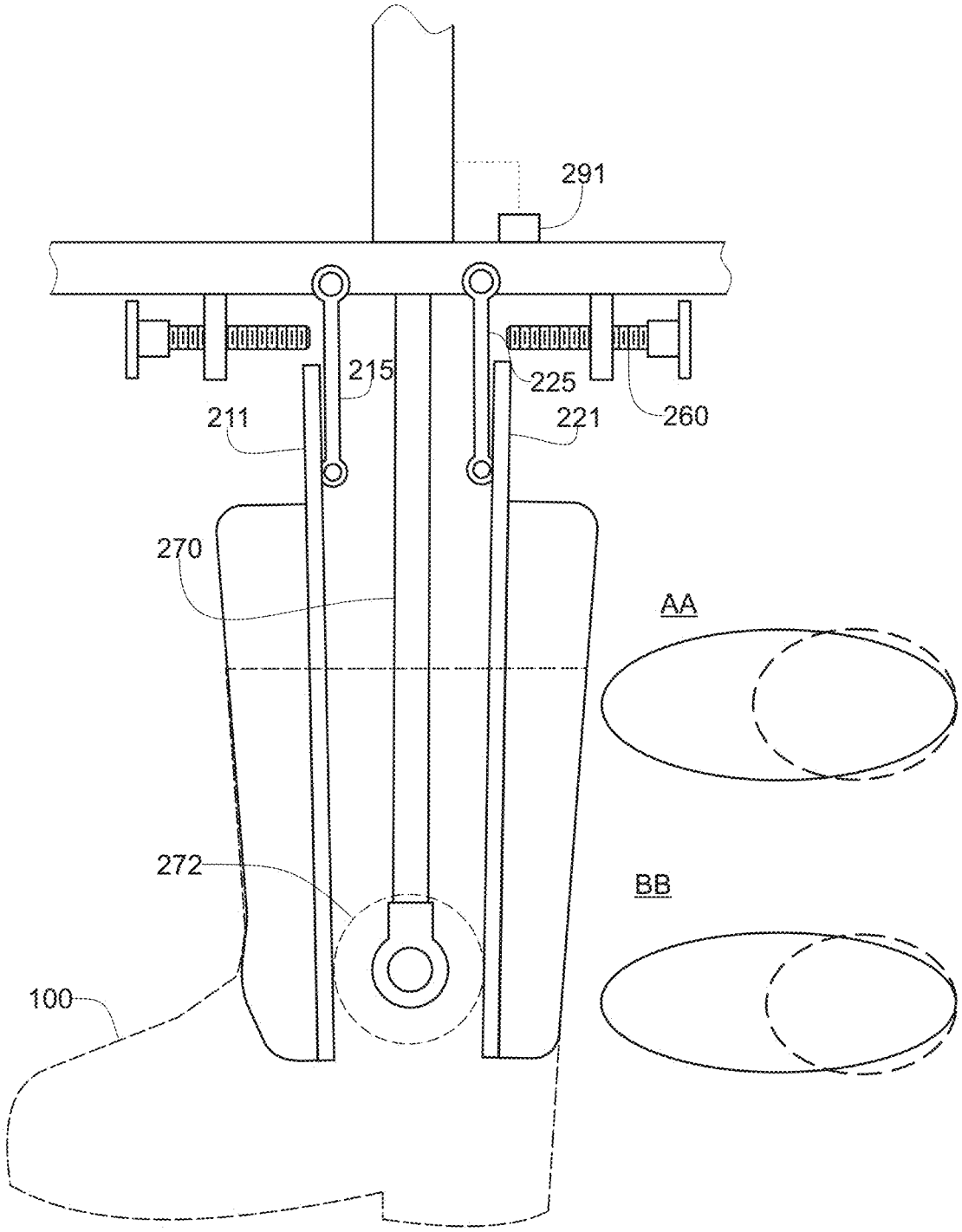
FIG. 4 is a front view of the apparatus of FIG. 2 and FIG. 3 in a configuration where the boot is stretched.

FIG. 4 starting form the configurations of FIG. 3 the first power actuator (270) is powered thus moving the rod (271) toward the distal ends of the shaft spacer blocs (210, 220).

Advantageously, before powering the first power actuator, the boot is sprayed with a stretcher spray, at least on the parts intended to be stretched.

A stretcher spray is for example a solution of isopropyl alcohol in distilled water.

As the rod of the first power actuator moves toward the distal ends of the shaft spacer blocs, the puck (272) tends to space apart the distal ends of the shaft spacer blocs, thus pivoting the connecting rods, relative to the frame. around the first pivotal link and relative to the shaft spacer blocs around the second pivotal link, up to the point when either the maximum stroke of the first power actuator is reached or when the rails of the shaft spacer blocs are aligned with the connecting rods.

In a specific embodiment, a force stretching sensor (291), either a pressure sensor on a hydraulic cylinder, a torque sensor or an electric intensity supply measurement of the electric motor in case of a jack screw or a rack and pinion mechanism, connected to a drive controller stops the stroke of the first power actuator in order to avoid damaging the rails or the connecting rods, when the device reaches one of these stop positions.

In an improved embodiment, the stretching force sensor may be adjustable in order to limit the stretching pressure in an intermediate preset stretching before a stop position is reached.

In the example of FIG. 4 a high stretching force is applied to the instep area but the response of the boot material and the conicity of the shaft spacer blocs make the stretching pressure to be applied to the hole shaft. Section AA shows the stretching applied to the collar area in this example, while the boot is hold on the spacer blocs, and section BB the stretching applied to the instep area in these same conditions, with the dotted line showing the respective initial sections of the boot as shown in FIG. 2.

The amount of stretching primarily depends on the puck (272) diameter and to a lesser extent on the initial setting of the shaft spacer blocs with the screws (260).

Therefore, by selecting the appropriate puck diameter not only the amount of stretching may be selected but also the distribution of the stretching intensity between the distal ends of the shaft spacer blocs and the rest of the shaft. An advantage of this device being also to apply a stretch both on the lower part of the boot, e.g. in the instep or counter area, and on the shaft in a single stroke of the first power actuator.

Figure 5:
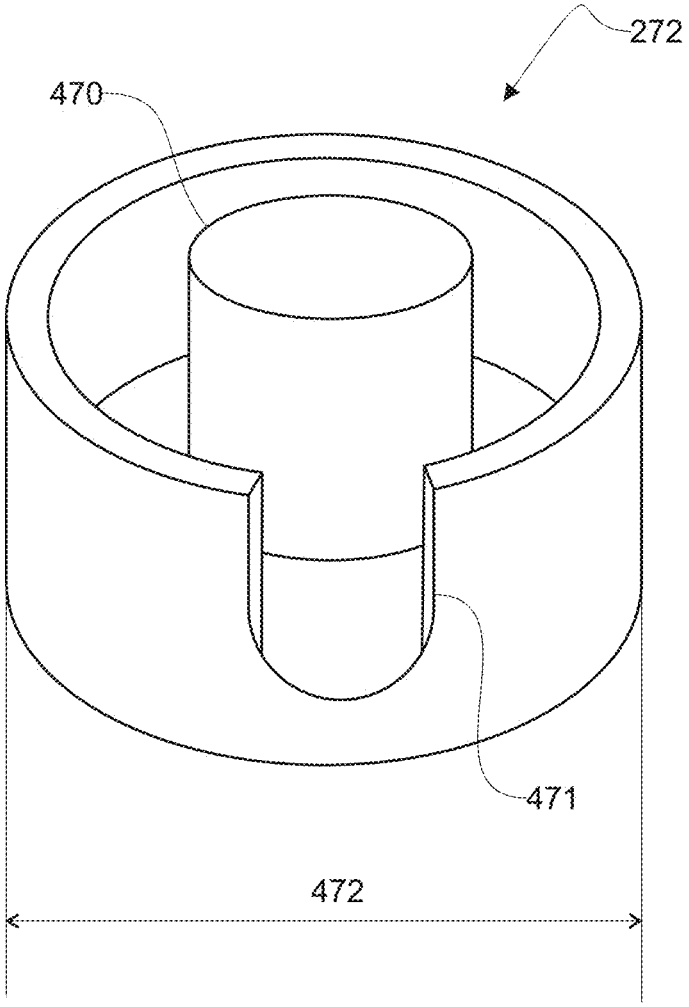
FIG. 5 is a perspective view of an exemplary embodiment of a puck adapted to the apparatus shown in FIG. 2 to FIG. 4.

FIG. 5, therefore the apparatus comprises a set of pucks of different external diameters (472) configured to be attached at the end of the power actuator rod. To this end, as an exemplary embodiment, the puck (272) comprises an internal pin (470) configured to fit in a hole (274 FIG. 1) at the end of the first power actuator rod and a slot (471) configured to be inserted over the first power actuator rod. Therefore, such a puck is easy to set at the end of the first power actuator rod, simply slipped into the first power actuator rod end, without any additional fixture, enabling to quickly make a progressive selection of the appropriate puck for an expected stretching result.

The puck (272) is preferably made of steel, and may receive a coating, such as PTFE, to reduced friction and wear thus avoiding the use of grease that could damage the footwear if spilled on it.

Because of the high stretching pressure resulting from the power of the first power actuator, the shape of the parts of the boot intended to be stretched in the selected areas are changed in a matter of seconds, and despite the elastic spring back of the material making the boot, once the pressure is released, the boot is durably stretched in the selected areas.

Therefore, the shoemaker may easily adjust a shoe to the morphology of a customer in a time that is compatible with a trying on spent at the shop.

Such an adjustment may require several operations. For instance, FIG. 2 to FIG. 4 are showcasing a stretching of the shaft, particularly in the instep area. The person skilled in the art understands that turning the boot by 90° compared to the configuration shown in these figures, enables to stretch the boot mainly in the counter area for stretching an ankle width of the boot.

Figure 6:
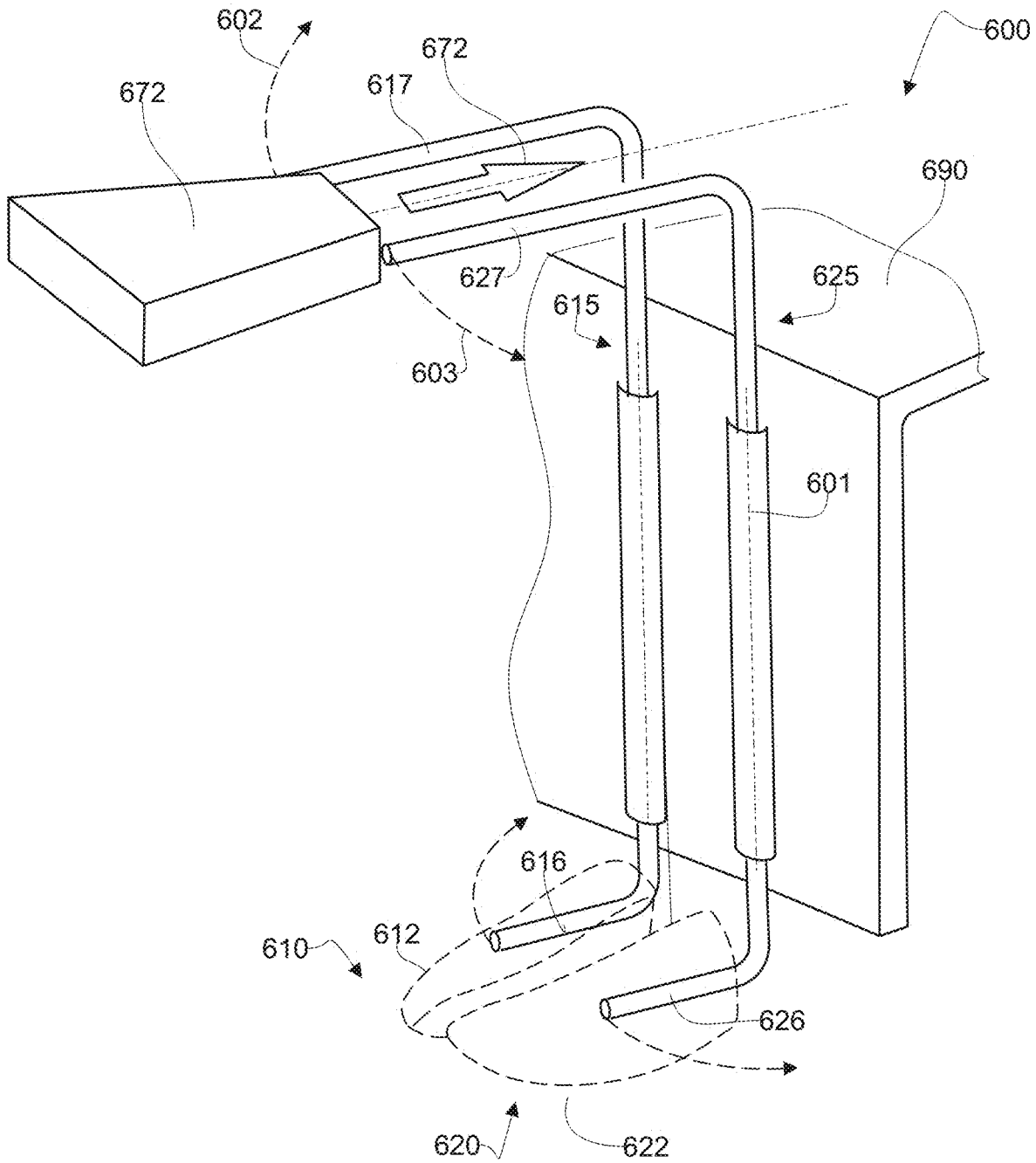
FIG. 6 is a simplified perspective view of a second embodiment of the apparatus.

FIG. 6 a second stretching set (600) is used for stretching the vamp, the box toe and the instep area of the footwear.

To this end, according to an exemplary embodiment, the second stretching set comprises a frame (690) and two bootie spacer blocs (610, 620) each comprising a bootie stretching shape (612, 622) in the shape of a shoe tree, extending in a lengthwise direction of the shoe to be stretched.

Each bootie stretching shape is releasably connected to a stud (616, 626) extending in a lengthwise direction of the shoe and making a lower portion of a double bent rod (615, 625), the double bent rod being connected to the frame by a pivotal link configured to rotate around a rotation axis (601) perpendicular to the stud.

An upper portion (617, 627) of the double bent rod is bent to be parallel to the stud (616, 626) of the lower portion.

In the free configuration of FIG. 6, before stretching, the two double bent rods are parallel to each other from an end of the lower portion to an end of the upper portion and the bootie spacer blocs (610, 620) may be inserted in a footwear to be stretched.

A wedge (672) is set inbetween the two upper portions (617, 627), the wedge being translationally movable by a second power actuator (not shown), like a hydraulic cylinder, a screw jack driven by an electric motor, or a rack and pinion mechanism driven by an electric motor, between the two upper portions.

Moving the wedge inwardly (670) by the second power actuator between the two upper portions (617, 627), causes the upper portions to space apart from each other thus making the double bent rods rotating in opposite directions (602, 603) around the rotation axis (601) of the pivotal links, thus opening a growing wedge-shaped gap between the studs (616, 626) and the bootie stretching shapes (612, 622) rotating outwardly, with the result of transversely stretching the footwear.

The stretching effect increases until the maximum stroke of the second power actuator is reached.

As for the first stretching set, an adjustable stretching force may be used to preset a maximum stretching pressure before the end of the second power actuator stroke.

The amount of stretching applied to the footwear is mainly set by the shape and the dimensions of the pair of the bootie stretching shapes that are selected and installed on the studs (616, 626) as well as by the dimensions of the wedge (672).

To this end the wedge (672) may be interchangeable and although the profile of the wedge (672) shown in FIG. 6 is basic, a more elaborate profile may be used to control the gradualness of the stretching pressure setting during the stroke of the second power actuator.

Nevertheless, in practice, the shoemaker will most likely control the intended stretching effect by selecting an appropriate pair of bootie stretching shapes (612, 622).

Better results are obtained by spraying a stretcher spray on the footwear before stretching.

The double bent rods (615, 625) are preferably made of steel as well as the wedge (672) and may be coated by a friction and wear reduction coating, thus avoiding the use of grease that may spill and damage the footwear.

The bootie stretching shapes (612, 622) may be made of an aluminum alloy, wood or a plastic material.

Because of the action of the second power actuator, the stretching pressure is high enough to durably stretch the footwear in the selected areas in a matter of seconds, thus enabling the footwear to be adjusted during a try on at the shop.

The two stretching sets may be set on a same frame, making a compact stretching machine for fully adjusting a footwear in the shaft areas and in the bootie.

The invention claimed is:

1. A footwear stretcher apparatus comprising a first stretching set comprising:

two spacer blocs separated by a wedge-shaped gap and configured to be inserted inside walls of a footwear;

a first power actuator; and a wedge, driven by the first power actuator, and configured to change a spacing of the wedge-shaped gap during a stroke of the first power actuator, thus stretching the walls of the footwear;

wherein the two spacer blocs are two shaft spacer blocs configured to be inserted into a shaft of the footwear and comprising a conical shape of a semi-circular section and wherein the wedge is a circular puck, attached to an end of a rod of the first power actuator and configured to translate in the wedge-shaped gap between the two shaft spacer blocs; and, wherein the circular puck has a round outer flat edge which engages the two shaft space blocs wherein the two shaft spacer blocs are each connected to a frame at a proximal end by a connecting rod comprising a first pivotal link with the frame and a second pivotal link with the shaft spacer bloc.

2. The apparatus of claim 1, comprising a plurality of interchangeable pucks with different external diameters.

3. The apparatus of claim 1, wherein the first power actuator is selected among a hydraulic cylinder, a screw jack driven by an electric motor, and a rack and pinion mechanism driven by an electric motor.

4. The apparatus of claim 1, comprising a stretching sensor and a drive controller of the first power actuator configured to limit the stroke of the first power actuator according to a preset stretching force.

5. The apparatus of claim 1, wherein one of the two shaft spacer blocs comprises a bulge at a distal end.

6. The apparatus of claim 1, comprising a second stretching set mounted on a same frame and comprising two bootie spacer blocs each comprising a shoe tree shape, each of the two bootie spacer blocs being releasably attached to a stud extending parallel to a lengthwise direction of the footwear, the stud being attached to a rod pivotably mounted to the frame with a rotation axis perpendicular to the stud, wherein a second power actuator, driving a wedge, is configured to pivotably space the two bootie spacer blocs by pivoting the studs outwardly during a stroke of the second power actuator.

7. The apparatus of claim 6, comprising a plurality of interchangeable bootie spacer blocs.

8. The apparatus of claim 6, comprising a plurality of interchangeable wedges of different profile.

9. The apparatus of claim 6, wherein the second power actuator is selected among a hydraulic cylinder, a screw jack driven by an electric motor, and a rack and pinion mechanism driven by an electric motor.

10. The apparatus of claim 6, comprising a stretching sensor and a drive controller of the second power actuator configured to limit the stroke of the second power actuator according to a preset stretching force.

* * * * *